US005749026A

United States Patent [19]

Goldie

[11] Patent Number: 5,749,026

[45] Date of Patent: May 5, 1998

[54] REMOVABLE SHIPPING SEAL FOR A TONER CARTRIDGE AND METHOD OF USING THE SAME

[75] Inventor: Glenn C. Goldie, Tariffville, Conn.

[73] Assignee: RTI International Corporation, Springfield, Mass.

[21] Appl. No.: 601,952

[22] Filed: Feb. 13, 1996

[51] Int. Cl.[6] ..... G03G 15/08

[52] U.S. Cl. ..... 399/103; 399/106

[58] Field of Search ..... 399/102, 103, 399/105, 106

[56] References Cited

U.S. PATENT DOCUMENTS

| | | | |
|---|---|---|---|
| 4,742,797 | 5/1988 | Barker | 399/105 |
| 5,235,130 | 8/1993 | Demoto et al. | 399/103 |
| 5,258,814 | 11/1993 | Davies | 399/105 |
| 5,264,901 | 11/1993 | Rossiter | 399/105 |
| 5,488,462 | 1/1996 | Ishikawa et al. | 399/103 |
| 5,592,268 | 1/1997 | Uehara et al. | 399/103 X |

*Primary Examiner*—Fred L. Braun
*Attorney, Agent, or Firm*—Cesari and McKenna,LLP

[57] ABSTRACT

A seal for a printer toner cartridge provides a flexible thin sheet material that can be folded to form two plies. The thin sheet material defines a seal that is wrapped around the developer roller of the toner cartridge so that a portion of the sheet material extends outwardly from the toner cartridge and can include a pull tab. The sheet material fills gaps formed between the developer roller and a doctor blade and also between the developer roller and a toner application roller. By sealing these gaps, a positive barrier to toner expulsion is created. The seal is easily removed by pulling on the pull tab to slide it over and away from the developer roller. The seal can include foam projections for enhanced sealing at the walls of the cartridge that can be formed from a polymer such as polyethylene.

25 Claims, 5 Drawing Sheets

REMOVABLE SHIPPING SEAL FOR A TONER CARTRIDGE AND METHOD OF USING THE SAME

FIELD OF THE INVENTION

This invention relates to a seal that prevents toner from leaking from a toner cartridge during shipment.

BACKGROUND OF THE INVENTION

Most modern laser printers and an increasing number of faxes, copiers and other image-transfer devices utilize self-contained, replaceable toner cartridges. These cartridges include a tank or tanks filled, typically, with a one-part toner, a toner metering system that includes a developer roller and a photo-sensitive image drum. Such cartridges are disposable, but are sufficiently complex so that they are normally recycled after the toner supply in the tank or tanks is exhausted.

A continuing annoyance that plagues both new and remanufactured toner cartridges is the leakage of toner during shipment. Various techniques have been employed to limit toner leakage. Most of these techniques involve the placement of a removable seal adjacent the outlet of the toner tank. During shipment, toner particles, which are sized a few microns or less, act almost as a fluid, tending to slosh about the tank and exhibit hydraulic pressure-like effects. During rough shipment, the pressure often defeats the loosely attached seals. Additionally, dropping the cartridge, subsequent to arrival can also lead to significant toner leakage. The leaking cartridge thus, may be covered in wasted toner before it is installed, soiling the printer interior and the installer.

FIG. 1 illustrates a seal utilized, in particular, in IBM Series 4019/4028/4029/4039/4049 printer cartridges. The toner tank 20 and developer roller structure 22 are shown separated from the remaining cartridge shell and image drum, which are normally attached, but have been omitted for clarity. The tank 20 includes a rotating agitator 24 to which the seal strip 26 is joined at one end 28. The seal strip 26 lays along the feed slot 30 of the tank 20 that leads into the developer roller structure 22. A series of metering rollers (not shown) are provided within the developer roller structure 22 for dispensing a predetermined quantity of toner from the tank 20 into the developer roller structure 22. These metering rollers will be described further below.

The prior art seal 26 is attached over the slot 30 with a low-tack contact adhesive. When the agitator 24 rotates, in response to the gear wheel 32 (shown in phantom), during operation of the printer, it rolls the seal 26 onto the axle 33 of the agitator 24, separating it from the slot 30. The rolled-up seal remains twisted around the agitator 24 throughout the subsequent operation of the cartridge. An advantage of the self-removing seal 26 is that it is automatically removed upon start-up of the printer without intervention by the operator. However, a major disadvantage is that the seal is, by necessity, only lightly adhered to the slot 30. It is, thus, prone to leakage and rupture during shipment. In addition, the far end 34 of the slot 30, adjacent the attached end 28 of the seal 26 is often poorly seated against the slot 30 and provides a ready opening through which toner can leak.

Thus, the prior art seal system of FIG. 1 exhibits several weaknesses that limit its effectiveness. The seal 26, which is generally constructed from a piece of relatively thick fabric ribbon takes up room inside the tank, reducing the amount of toner that can be placed within the tank 20. The seal 26, due to its weak adhesion to the slot 30, cannot withstand a strong pulse of hydraulic pressure which could result from a completely filled toner tank. Thus, toner levels are usually maintained at only approximately ¾ of the tank capacity to reduce "pressures" within the tank during rough handling.

Attempts have been made to overcome the disadvantages of the self-removing seal shown in FIG. 1 by providing an operator-removed seal (not shown) having a pull tab that exits the tank. The operator pulls the tab, which removes a more-securely adhered seal from the tank feed slot. However, this seal is still prone to leakage and the exit hole through which the pull tab is located provides yet another passage for toner leakage. In addition, the cartridge can be installed and operated without removing this type of seal and substantial time, and paper, can be wasted before the operator realizes that the seal has not yet been removed, since the cartridge can run with the seal still in place.

It is, therefore, an object of this invention to provide a toner cartridge seal that provides a more-reliable and positive seal during shipment. This seal should enable the toner tank to be filled further and should resist outward pressures of toner during rough handling. The seal should be located so that its presence is obvious to an operator, and should be easily removable prior to installation of the cartridge within a print engine. Finally, the seal should be easy to install during manufacture of the cartridge and inexpensive and easy to manufacture.

SUMMARY OF THE INVENTION

A toner cartridge seal according to this invention, overcomes the disadvantages of the prior art by providing a seal that firmly engages impinging surfaces at the developer roller across the entire surface of the developer roller. As such, this seal forms a "final barrier" to toner leakage. In its simplest form, the seal is constructed from a thin sheet of material that is wrapped around the developer roller.

In one embodiment, this invention provides a toner cartridge seal that is located to seal the metering system of the cartridge. The metering system includes, generally, metering roller having a predetermined width and closely spaced surfaces adjacent the metering roller. The seal is constructed from a thin sheet material that is sized and arranged to wrap around the metering roll with opposing side edges that are spaced apart a distance that is approximately equal to the predetermined width of the metering roller. The thin sheet material has a thickness that, when wrapped around the metering roller in a predetermined orientation, spans a gap formed between a surface of the metering roller and the closely-spaced surfaces to seal each gap against passage of toner therethrough.

One of the closely-spaced surfaces can comprise a doctor blade. Another closely-spaced surface can comprise a resilient toner application roller. The metering roller can be a developer roller according to this embodiment. The thin sheet material can comprise a flexible polymer, such as polyethylene. The thin sheet material can be constructed in two plies and can include soft pliable projections, such as foam, that extend outwardly beyond the side edges of the sheet to seal against walls of the toner cartridge. Such projections are typically located at a gap formed along the doctor blade. The toner cartridge can further include a D-roller located in communication with a slot of a toner tank in the cartridge. The D-roller provides metered amounts of toner to the foam application roller.

A method for removably sealing a toner cartridge having an image transfer drum and a toner metering system that delivers toner to the image transfer drum is also provided. This method includes the step of locating a thin sheet material in engagement with gaps defined in the metering system. This metering system can comprise a developer roller and the gaps can be formed between the developer roller and a doctor blade and between the developer roller and an impinging resilient toner application roller. The thin sheet material can be located so that a free end of the thin sheet material is positioned outwardly of the image transfer drum. The thin sheet material is selectively removed from the gaps by pulling on the free end in a direction outwardly away from the image transfer drum so that the sheets slidably passes out of the gaps.

The step of locating the thin sheet material can include wrapping the thin sheet material around the developer roller. Additionally, the step of locating can include positioning a pair of crushable projections, that comprise foam, in engagement with opposing sidewalls of the toner cartridge to seal a space between the side edges of the thin sheet material and the sidewalls adjacent the doctor blade.

BRIEF DESCRIPTION OF THE DRAWINGS

The foregoing and other objects and advantages of the invention will become more clear with reference to the following detailed description as illustrated by the drawings in which.

DETAILED DESCRIPTION

Figure 1:
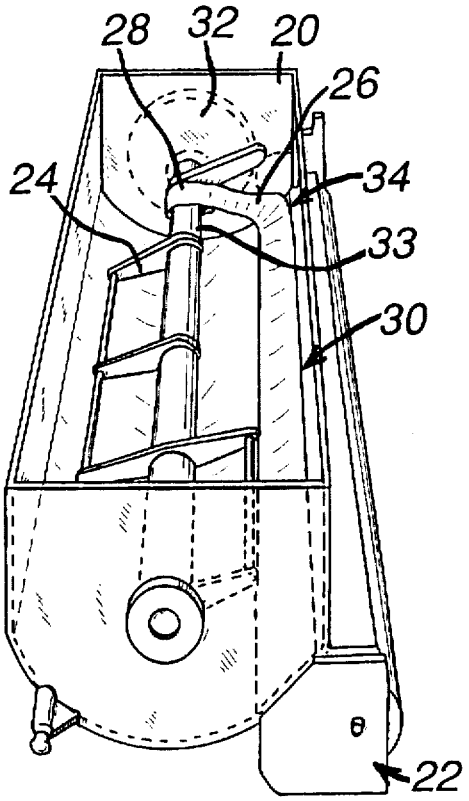
(PRIOR ART) Fig. 1
FIG. 1 is an exposed perspective view of a toner tank and developer roller system having a self-removing seal according to the prior art.
Figure 2:
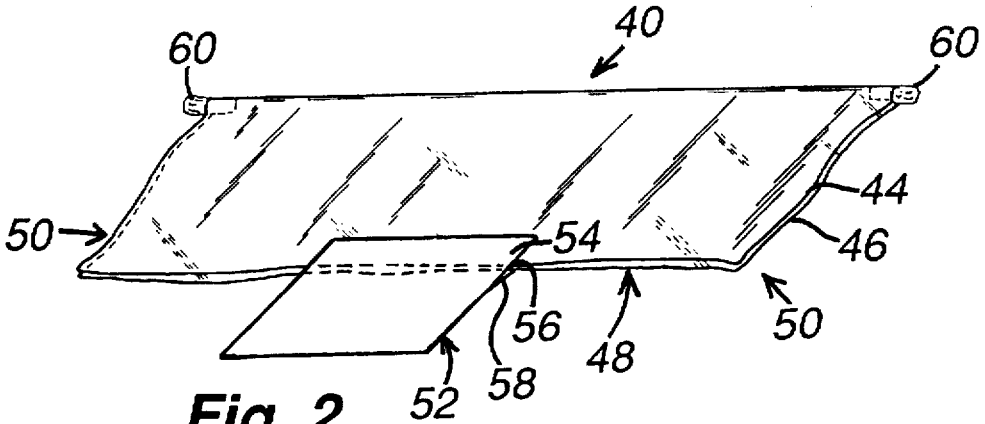
FIG. 2 is a perspective view of printer toner cartridge seal according to this invention.
Figure 3:
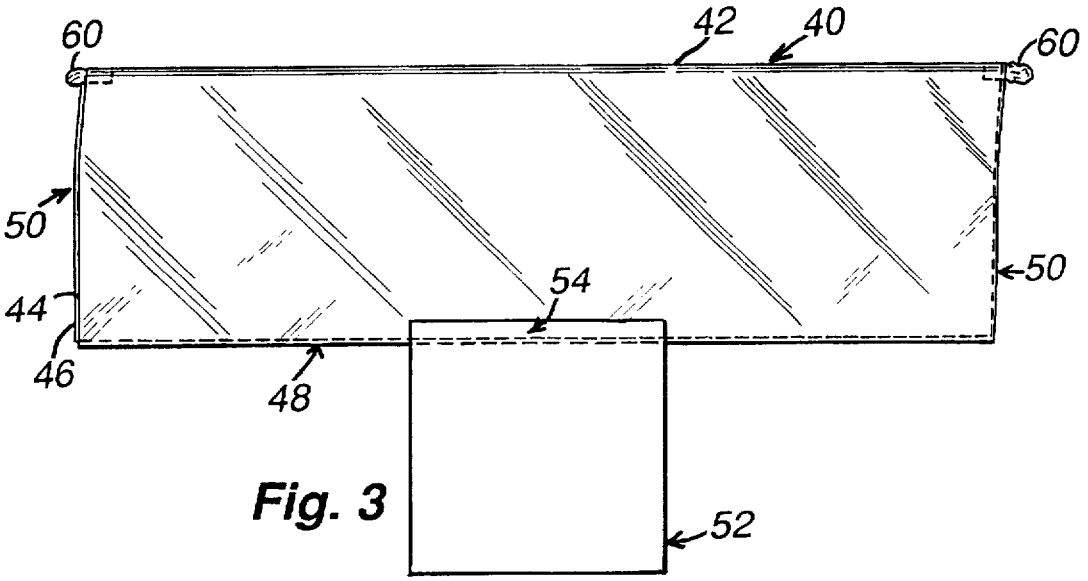
FIG. 3 is a plan view of the printer toner cartridge seal of FIG. 2.

A toner cartridge seal according to a preferred embodiment of this invention is detailed in FIGS. 2 and 3. The seal 40, according to this embodiment, comprises a six mil transparent polyethylene sheet folded along fold line 42 to define two equally dimensioned plies 44 and 46 that are open along their front edge 48 and side edges 50. A pull tab 52 is adhered along the front edge 48. The pull tab 52 can also comprise a paper or synthetic sheet material that is adhered along a common overlapping section 54 to the two-ply faces 44 and 46. As detailed in FIG. 2, the tab 52 can comprise two plies 56 and 58 of material. For example, the two plies 56 and 58 can comprise opposing adhesive sheets that are joined in a face-to-face relationship for a permanent joint. Alternatively, the pull tab can comprise an extension of the front edge 48 of the seal plies 44 and 46. This form of integral pull tab is described below with reference to another embodiment.

Adjacent the fold line 42, projecting from each of the side edges 50, are small segments of foam 60 or a similar soft, pliable material. In this embodiment, the foam comprises a conventional synthetic closed-cell foam that can be self-adhering. Such foam is available from a variety of commercial sources. The foam has a thickness of approximately 1/16 inch and a has a width, taken along the respective side edge 50 of approximately 1/8 inch. The foam projections 60 extend outwardly from each side edge 50 a distance that is also approximately 1/8 inch.

Figure 4:
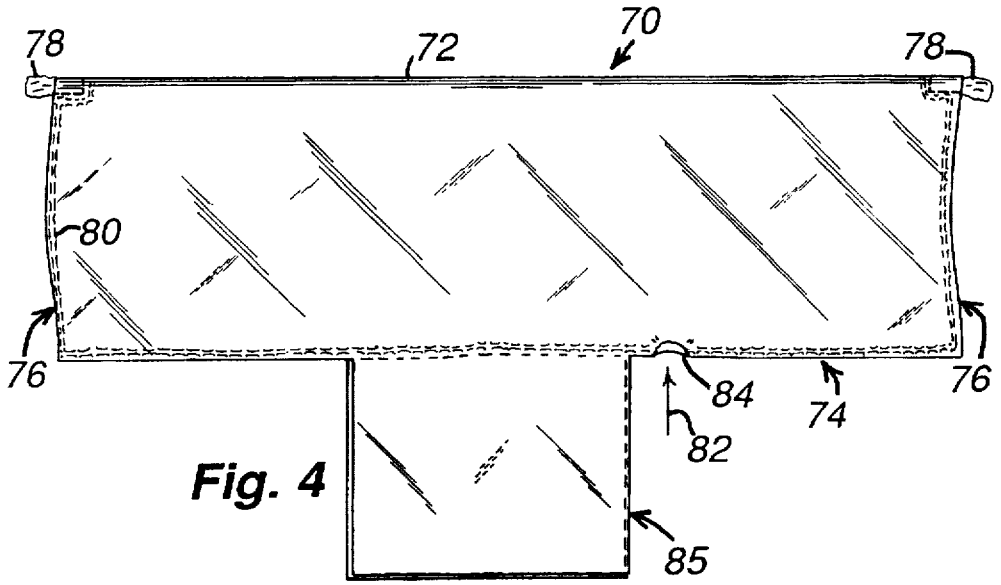
FIG. 4 is an inflatable printer toner cartridge seal according to an alternate embodiment of this invention.

FIG. 4 illustrates an alternate embodiment of the seal according to this invention. The seal 70 is also formed from a two-ply polymer material according to this embodiment. It includes a rear fold edge 72, a front edge 74, and side edges 76. It also includes respective foam projections 78 that extend from the side edges 76 at the rear fold edge 72. The two plies of the seal 70 according to this embodiment are joined by heat seals, cement, or other crimping processes along a continuous seam 80. In this embodiment, the seam 80 is constructed so that air cannot infiltrate through it. Such a seam can be constructed using, for example, conventional heat sealing devices for use with plastic bags and wrapping material. The seam 80 extends to the fold edge 72 and follows the side edges 76 and front edge 74 to an opening 84 formed along the front edge 74. The opening 84 remains unsealed in this embodiment so that air or another pressurized gas can be inserted (arrow 82) between the two plies to create an inflated region between the two plies. As will be described further below, such inflation can improve sealing under certain circumstances. The opening 84 is designed to be sealed subsequent to application of air. Note that the foam projections 78 remain outside the seam 80 so that a positive air seal can be maintained between the plies of the seal 70.

In the embodiment of FIG. 4, the pull tab 85 is an integral extension of the front edge giving the seal 70 a "T-shaped" appearance. Any of the seals shown and described herein can be provided with an integral pull tab.

Figure 5:
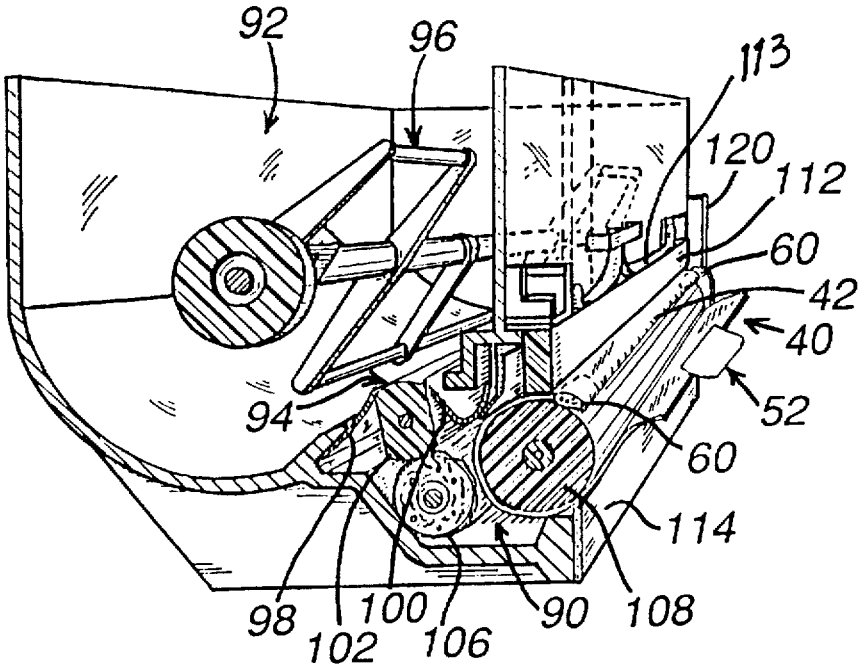
FIG. 5 is a cross-sectional perspective view of a toner tank and developer roller assembly employing a seal according to this invention.
Figure 6:
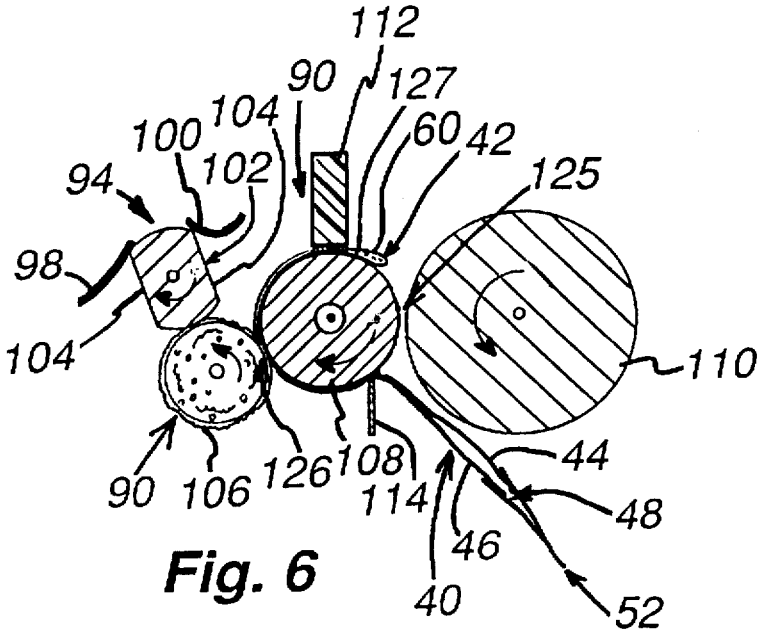
FIG. 6 is a partial cross-section of the seal engaging the developer roller assembly.
Figure 7:
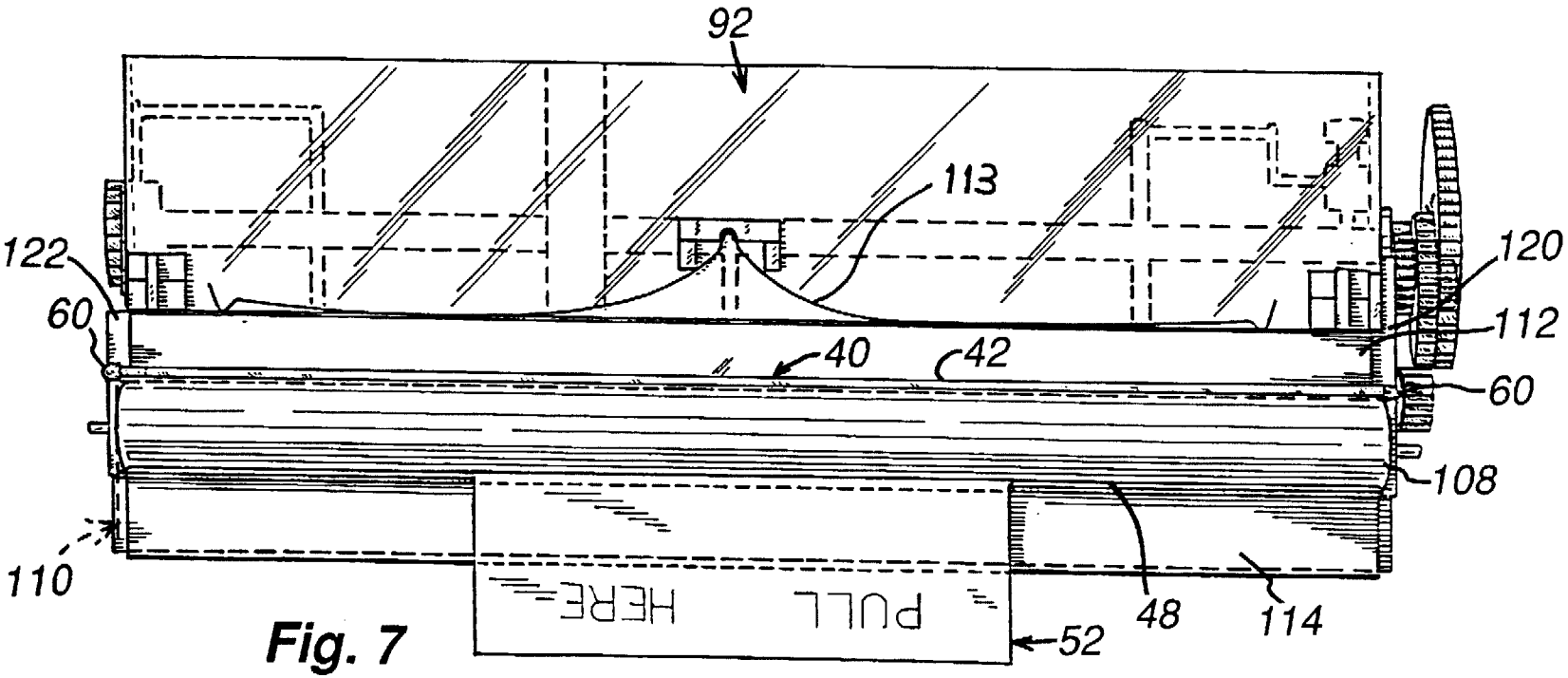
FIG. 7 is an exposed front view of the toner tank and developer roller assembly with the seal in place.

With reference to FIGS. 5, 6 and 7, the seal 40, according to one embodiment is shown in engagement with the developer roller assembly 90 of an exemplary printer toner cartridge. The cartridge toner tank 92 holds toner particles that are moved toward an outlet slot 94 by a moving agitator 96. The slot 94 is defined by a pair of MYLAR or similarly flexible sealing flaps 98 and 100. These flaps 98, 100 bear against a rotating metering structure known as a D-roller 102 that includes a pair of opposing flats 104 that face the slot 94 during alternating 180° rotations. A given amount of toner falls through the slot 94 onto one of the flats 104 of the D-roller 102 providing a relatively metered batch of toner to the developer roller section 90. As noted above, the printer toner cartridge described herein is used, particularly in the IBM 4019/4028/4029/4039/4049 series printers. However, the seal described herein can be adapted to a variety of systems using differently designed developer roller arrangements as will be described further below.

The D-roller 102 delivers toner to a porous foam applicator roller 106. The foam roller 106 is maintained in resilient contact with both the D-roller and the developer roller 108. The developer roller 108 is made electrostatically attractive so that a predetermined amount of polarized toner adheres to its surface. The developer roller 108 then transfers toner to the photosensitive drum 110 (FIG. 6 and shown in phantom in FIG. 7) to fill electrostatically charged areas of the photosensitive drum 110, forming an image. The exemplary printer cartridge includes a doctor blade 112. The doctor blade 112 scrapes off excess toner on the developer roller 108. The blade 112 touches the developer roller under the pressure of a leaf spring 113. In some cartridges, a fixed gap is provided. However, for the purposes of this description, the term "gap" shall be construed to include an approximately zero-clearance gap as shown, since some small gaps are always present between the pressurized doctor blade 112 and developer roller 108, and between the toner application roller 106 and developer roller 108. A lower MYLAR® sealing flap 114 is also located in a closely spaced arrangement adjacent the bottom of the developer roller 108.

The seal 40 according to this embodiment is wrapped around the developer roller 108 so that the fold edge 42 extends forwardly slightly (0.1–0.3 inch) beyond the doctor blade 112 and the front edge 48 of the seal 40 extends out from between the developer roller 108 and the photosensitive drum 110. The width of the seal 40 is chosen so that it extends across substantially the entire width of the developer roller 108. The length of the seal, which is approximately three to five inches in this embodiment, is sufficient to enable the seal 40 to be wrapped around the roller 108 with the front edge 48 located beyond the nip 125 (FIG. 6) between the image transfer drum 110 and develop roller 108. Each foam projection 60 extends beyond the width of the developer roller 108 so that it bears tightly against a respective of the side walls 120 and 122 (see FIG. 7) of the cartridge frame. The foam, thus, crushes to seal any gap between the side walls 120 and 122 and the side edges 50 of the seal 40. It is contemplated that the size and shape of the projections 60, as well as their material, can be varied based upon the resilience of the material and the shape of the cartridge and sidewalls.

The foam projection 60, as shown in FIG. 6, also help increase the thickness of the seal plies 44 and 46 at the fold edge 42 with an air space 127. In other words, the foam projections 60 cause the material to "balloon" along the fold edge 42. This ballooning helps to form a tight seal between the doctor blade 112 and the developer roller 108. The seal 40 also passes between a developer roller 108 and the foam roller 106 at their impingement point 126. By filling any gaps between the doctor blade 112 and the developer roller 108 and between the developer roller 108 and foam roller 106, the seal positively isolates the developer roller section 90 from the outside. Thus, any toner that is able to slip through the tank slot 94 is stopped by the seal 40. The foam projections 60 fill the gap, since they lock positively against the sidewalls 120 and 122 of the cartridge frame. Further sealing occurs where the MYLAR® flap 114 bears against the developer roller 108 since the seal fills most or all of the gap therebetween.

Figure 8:
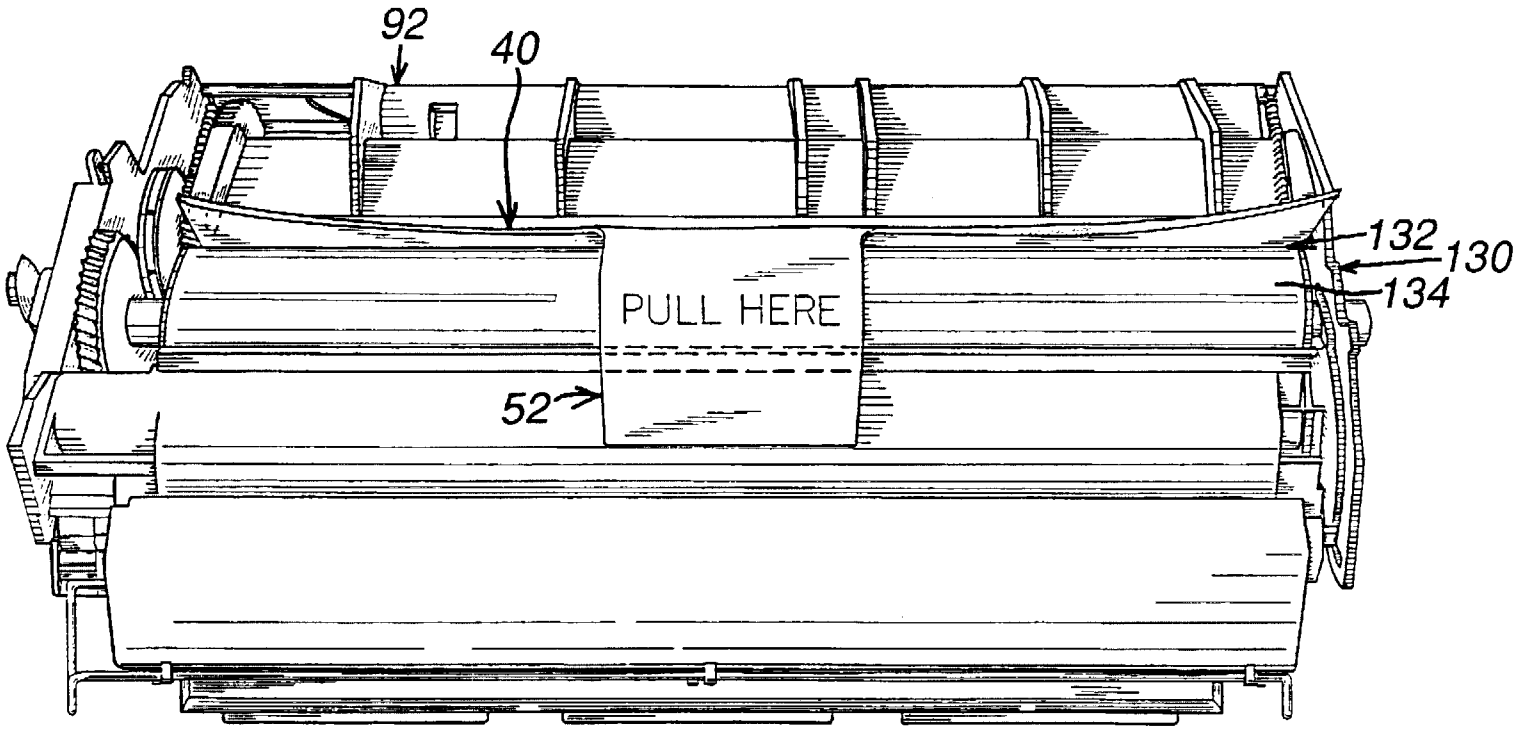
FIG. 8 is a partial bottom perspective view of a printer toner cartridge having the seal in place according to this invention.

Since the seal 40 is formed from a flexible, thin sheet material, it can be easily removed when the cartridge is ready for use. As further detailed in FIG. 8, the pull tab 52 extends outwardly from the bottom of the cartridge 130 through the slot 132 in the image drum's movable protective door 134. It is clearly visible upon handling the cartridge 130. The tab 52 is pulled outwardly away from the cartridge, sliding the seal around the developer roller 108, between the toner application roller 106, and out of the slot 132. The foam projections 60 are soft enough to provide minimal resistance to the pulling action and crush to pass easily under the doctor blade 112 and toner application roller 106. Similarly, the spring 113 of the doctor blade 112 will allow the blade 112 to displace as the projections 60 pass thereunder during removal. Polyethylene or another sturdy polymer has a sufficiently low friction coefficient relative to the developer roller to allow the seal 40 to slide easily along the developer roller without damaging it or the image drum 110. Hence, by a simple pulling action which removes the seal from the cartridge 130, the cartridge is now ready for use.

As noted above, an alternate embodiment of the seal as detailed in FIG. 4 can be filled with air or a similar pressurized gas to provide an inflated seal 70. By inflating the seal, the two plies can expand to further fill any gaps between the doctor blade 112, foam toner application roller 106, MYLAR® flap 114 and image drum 110, with respect to the developer roller 108.

As noted above, the seal according to this invention is designed to be placed into the printer toner cartridge at time of manufacture or remanufacture and removed upon delivery or use by an end-user. Installation of the seal into a cartridge is generally only performed at the time of manufacture or remanufacture. To install the seal, it can be wrapped around the developer roller as the developer roller is installed into the cartridge. Conversely, a special semi-rigid shim constructed from metal, MYLAR® or another flexible polymer (not shown) can be used to drive the seal around an assembled developer roller assembly until the fold edge 42 extends outwardly from the doctor blade 112. Such a shim could be curved to wrap around the developer roller 108. It, typically, would bear against the inside of the fold edge 42 to drive it up around the roller 108 and to generate a gap at the doctor blade 112 by pushing against the spring 113. The shim would be removed by reversing its travel once installation of the seal is completed. In any installation technique, it is desirable to orient the fold edge 42 so that the foam projections 60 are properly aligned relative to the cartridge frame sidewalls 120 and 122 and the ballooned part (127 in FIG. 6) of the fold edge 42 is positioned in engagement with the outer face of the blade 112.

While a two-ply seal is shown and described, a one-ply seal or multi-ply (three or more plies) seal can be utilized. It is desired, primarily, that the plies be sufficient to fill the gap between the doctor blade and developer roller and any other gaps that must be sealed to close off the developer roller section 90. Additionally, while foam projections 60 are shown and described, it is contemplated that other pliable end stops can be used, or that a very closely conforming integral structure in the seal material can be used at each sidewall.

Likewise, the seal can be formed from a variety of materials including paper, fabric, composite materials, fibrous materials, and a variety of polymers. As used herein, the term "thin sheet material" shall refer to any material having sufficient flexibility to be wrapped around a developer roller and to be completely removable by a pulling action that slides the seal relative to the developer roller. Such a thin sheet material should also be of a thickness, when formed in an appropriate number of plies, to fill gaps between the developer roller and closely spaced or impinging structures.

Furthermore, while an IBM model printer toner cartridge is shown herein, it is contemplated that the seal according to this invention can be used with a variety of toner cartridges, both monochrome and multicolored. It is desired primarily that such cartridges have a developer roller or similar metering structure adjacent an image transfer drum and that a seal can be wrapped around such a metering roller so that it fills gaps between the roller and closely-spaced or impinging structures. For example, an SX-type cartridge can have a seal provided between the doctor blade and the developer roller and between the image transfer drum, itself, and the developer roller. In addition, cartridges like the SX can be provided with filler material that generates a closely spaced structure adjacent the developer roller in an otherwise, open area. The filler material can provide a surface against which the seal can bear to close the gap. The cartridge need not include a D-roller or other toner application rollers to utilize the seal according to this invention and the seal can be used in conjunction with a roller that is in direct contact with the toner tank. In such an embodiment, the seal would typically face a feed slot of the toner tank, itself. The seal of this invention is effective because it closes off one of the outermost portions of the image transfer mechanism in a positive manner, but since the outermost area is most accessible, it makes the seal easy to remove.

The foregoing has been a detailed description of a preferred embodiment. Various modifications and additions can be made without departing from the spirit and scope of this invention. For example, the seal of this invention can be utilized with cartridges that dispense one-part, two-part, magnetic or nonmagnetic toners. The cartridges can be used in printers, faxes, photocopiers or other image transfer devices. The foam projections described herein can be substantiated with a similar pliable/crushable sealing material such as felt, cotton waddling or fabric. The seal can be supplemented with a low-tack adhesive that engages the cartridge elements. Finally, while the depicted side edges of the seal extend substantially the entire width of the developer roller, it is expressly contemplated that the side edges can be narrowed in areas that are not adjacent gaps to be filled, forming an "H" or "T" configuration (not shown). Accordingly, this description is meant to be taken only by way of example and not to otherwise limit the scope of the invention.

What is claimed is:

1. A toner cartridge seal for a toner cartridge having a rotating toner developer roller, the developer roller having a predetermined width aligned with an axis of rotation thereof and the toner cartridge further having closely spaced surfaces adjacent the developer roller, the seal comprising:

a thin sheet material sized and arranged to wrap around the developer roller with opposing side edges that, along at least a portion thereof, are spaced apart a distance approximately equal to the predetermined width of the developer roller and the thin sheet material having a thickness that, when wrapped around the developer roller in a predetermined orientation, spans a gap formed between a surface of the developer roller and each of the closely spaced surfaces to seal each gap respectively against passage of toner therethrough and a pair of soft pliable projections that extend outwardly in a direction aligned with the predetermined width beyond the side edges to seal against respective adjacent walls of the toner cartridge.

2. The seal as set forth in claim 1 wherein one of the closely spaced surfaces comprises a doctor blade.

3. The seal as set forth in claim 2 wherein another of the closely spaced surfaces comprises a resilient toner application roller.

4. The seal as set forth in claim 1 further comprising a pull tab, extending from an edge of the thin sheet material, constructed and arranged to extend outwardly from the toner cartridge.

5. The seal as set forth in claim 1 wherein the thin sheet material comprises a folded two-ply sheet.

6. The seal as set forth in claim 1 wherein the projections comprise foam projects.

7. The seal as set forth in claim 1 wherein the thin sheet material comprises polyethylene.

8. The seal as set forth in claim 1 wherein the toner cartridge includes a D-roller and a foam toner application roller in communication with the developer roller.

9. The seal as set forth in claim 1 further comprising a photosensitive drum that rotates to deliver toner as in image to a predetermined surface and that has a drum surface located adjacent to and in communication with the developer roller.

10. The seal as set forth in claim 1 wherein the thin sheet material includes at least two plies and wherein the predetermined orientation defines a ballooned span between at least a portion of the two plies the projections being located within the ballooned span and wherein the ballooned span is located adjacent a gap formed between the surface of the developer roller and one of the closely spaced surfaces.

11. In combination a toner cartridge and a removable seal comprising:

a toner tank having a toner feed slot;

a photosensitive drum for delivering toner in patterns to a predetermined surface;

a toner metering system that transfers toner from the toner tank to the photosensitive drum in predetermined metered quantities, the metering system including moving metering components and fixed components with gaps defined between at least some of the metering components and fixed components;

a flexible thin sheet material wrapped around at least one of the metering components, the flexible thin sheet material comprising at least two plies of resilient material overlaid atop one another, the two plies joining at a fold line wherein the two plies define, adjacent to the fold line, a ballooned portion with an airspace therebetween, and the thin sheet material having a thickness that substantially fills at least some of the gaps to block exit of toner through the gaps, the sheet having a free end located outwardly of the photosensitive drum at a location along an exterior of the toner cartridge wherein the thin sheet material is constructed and arranged to be removed from the one of the metering components about which the thin sheet material is wrapped by pulling on the free end to slidably move the thin sheet material relative to the gaps; and wherein the ballooned portion is located in engagement with one of the gaps to further seal against the one of the gaps with which the ballooned portion is engagement and wherein each of the two plies is in engagement with each other of the gaps but are substantially filled by the flexible thin sheet material to thereby block exit of toner.

12. The combination as set forth in claim 11 wherein the metering system includes a developer roller and wherein the thin sheet material is wrapped around the developer roller.

13. The combination as set forth in claim 12 wherein the fixed components include a doctor blade.

14. The combination as set forth in claim 13 wherein the moving metering components include a resilient toner application roller and wherein the thin sheet material is located between the developer roller and the toner application roller.

15. The combination as set forth in claim 14 wherein the metering components include a D-roller having at least one flat surface located in communication with the feed slot.

16. The combination as set forth in claim 11 wherein the thin sheet material comprises a polymer.

17. The combination as set forth in claim 11 wherein the toner cartridge includes respective side walls and further comprising a pair of crushable projections that extend outwardly away from the thin sheet material in engagement with the respective side walls.

18. The combination as set forth in claim 17 wherein at least a portion of each of the crushable projections is located between each of the two plies adjacent the ballooned portion.

19. The combination as set forth in claim 11 further comprising a projecting pull tab located along the free end.

20. A method for removably sealing a toner cartridge having a photosensitive drum and a toner metering system including movable metering components and fixed components that deliver toner to the photosensitive drum comprising the steps of:

locating a thin sheet material in engagement with gaps defined in the metering system including positioning the thin sheet material so that a free end of the thin sheet material is located outwardly of the photosensitive drum the step of locating including positioning the thin sheet material so that two plies of the thin sheet material are located in an overlapping relation and wherein each of the two plies engage the gaps, the two plies being joined at a fold line, the step of locating further including engaging a portion of the thin sheet material adjacent the fold lines defining a ballooned portion with an airspace therein in engagement with one of the gaps to further seal the one of the gaps; and selectively removing the thin sheet material from the gaps by pulling on the free end outwardly away from the photosensitive drum to slidably pass the thin sheet material out of the gaps.

21. The method as set forth in claim 20 wherein the step of locating including wrapping the thin sheet material around a developer roller of the metering system.

22. The method as set forth in claim 21 wherein the step of wrapping includes locating the thin sheet material between a doctor blade and the developer roller to fill a gap formed therebetween.

23. The method as set forth in claim 22 wherein the step of wrapping further comprises locating the thin sheet material between the developer roller and an impinging resilient toner application roller.

24. The method as set forth in claim 23 further comprising positioning a pair of crushable projections in engagement with opposing side walls of the toner cartridge to seal a space between side edges of the thin sheet material and the side walls adjacent the doctor blade.

25. The method as set forth in claim 24 wherein the step of positioning the pair of crushable projections includes locating the crushable projections adjacent the fold line with portions of the crushable projections mounted between each of the two plies within the ballooned portion.

* * * * *